United States Patent [19]

Stiles

[11] 4,313,560

[45] Feb. 2, 1982

[54] CONTROL SYSTEM FOR ENVIRONMENTAL UNITS

[76] Inventor: Jack L. Stiles, 3912 Acapulco, Irving, Tex. 75062

[21] Appl. No.: 173,671

[22] Filed: Jul. 29, 1980

[51] Int. Cl.[3] ..... F23N 5/20; F25B 29/00

[52] U.S. Cl. ..... 236/46 R; 165/16; 165/22

[58] Field of Search ..... 165/22, 16, 12; 236/51, 236/46 R, 47

[56] References Cited

U.S. PATENT DOCUMENTS 3,633,820 1/1972 Weissohn ..... 236/46 R 4,077,566 3/1978 Bradford ..... 236/51 X

*Primary Examiner*—William E. Wayner

*Attorney, Agent, or Firm*—Kanz & Timmons

[57] ABSTRACT

A control system (12) for environmental units (10) such as air conditioners or heaters is disclosed.

A control panel (14) accommodates a control module (16) associated with each unit. First and second temperature reference circuits (58 and 60) are located in each module for setting first and second reference temperatures. A circuit (64) responsive to a clock (62) selects the first reference temperature during a first predetermined time period and the second reference temperature during a second predetermined time period. Each unit is thermostatically controlled according to the selected reference temperature.

11 Claims, 5 Drawing Figures

CONTROL SYSTEM FOR ENVIRONMENTAL UNITS

DESCRIPTION

Technical Field

The present invention relates generally to systems for air conditioning and heating and, in one of its aspects, to a system for controlling a plurality of zoned environmental units such as air conditioners or heaters.

It has been common in the past to air condition and heat large buildings such as schools and hospitals through elaborate ductwork brought in from large central air conditioning and heating units. There has, however, been a trend toward having smaller units, each unit located closer to a particular environmental zone which it is to regulate. Due to the high cost of operating environmental units such as air conditioners and heaters, there has been a determined effort by the industry to use such units efficiently. Such efforts have lead to timed control systems which automatically shut the units down during periods when the zoned environments are not in use, using the maximum amount of fresh air from the outside when the fresh air is the appropriate temperature and completely shutting out fresh air during warm-up and cool-down prior to the time of expected use of a particular environmental zone.

Background Art

The background art for control systems of such zoned environmental units has been to either leave the controls for each unit in the vicinity of the particular environmental zone of that unit or to individually wire controls from a particular environmental unit back to a central control panel, the entire control panel being individually wired to accommodate all of the control circuitry, etc. needed for the individual units. As a result, systems with centralized control have been complicated, and adding additional units has been costly and tedious. In addition, by individually wiring each unit, mistakes have been frequent and debugging such systems has been difficult.

DISCLOSURE OF INVENTION

A system according to the present invention for controlling a plurality of zoned environmental units such as air heaters or air conditioners includes a control panel and a control module associated with each unit, located on or within the control panel. Means are provided for sensing the temperature within each zoned environment. A first temperature reference circuit is located in each control module for setting a first reference temperature, and a second reference circuit is located in each module for setting a second reference temperature. A clock is provided, preferably on the panel and connected in parallel to the modules. Means associated with each unit responsive to the clock, select the first reference temperature during a first predetermined time period and the second reference temperature during a second predetermined time period. Means associated with each unit, which can be in the module or at the unit, turn the unit on when the difference between the temperature sensed by the temperature sensing means and the selected reference temperature for that unit is a predetermined turn on amount and off when the difference is a predetermined turn off amount.

In one system according to the present invention, each unit has means for adjusting the ratio of intake air brought into the unit between return air from the zoned environment and fresh air from outside the zoned environment and a blower motor for forcing the intake air through the unit and into the zoned environment. An enthalpy control associated with each unit controls the intake air ratio adjusting means for maximum unit efficiency given a predetermined minimum percentage of fresh air. Such predetermined minimum might be set by some governmental unit for safety and health purposes.

In one arrangement, the first temperature reference circuit comprises a temperature setpoint circuit in each control module for setting a setpoint temperature, and the second temperature reference circuit comprises a temperature setback circuit in each control module for setting a setback temperature which differs from the setpoint temperature by a predetermined amount and a temperature reference circuit in each control module, responsive to the clock for setting a reference temperature equal to the setpoint temperature during a first predetermined time period of the clock and equal to the setpoint temperature plus the setback temperature during the second predetermined time period of the clock.

In one arrangement, a clock-in connector is affixed to each control module, and a clock-out connector is affixed to each control module and electrically connected to the clock-in connector. The clock-in connector of each control module is electrically connected to the clock or the clock-out connector of a different control module so that the modules and the clock are electrically connected in parallel combination.

In one arrangement, the temperature reference circuit in each control module is responsive to a manual override rather than the clock when the manual override is activated.

In a preferred arrangement, unit modules are located in or near each unit, having connections for the means for sensing the temperature within each environmental zone, the means for sensing the temperature from a fresh air source outside the zoned environment and the means for adjusting the ratio of intake air between return air from the environmental zone and fresh air, and containing a logic circuit for controlling the unit and the air ratio means.

As a result of the modular construction, a method according to the present invention for installing a system according to the present invention includes the steps of installing a panel, and installing on or in the panel a control module for each unit, containing means for setting reference temperatures for the particular unit. A preferred method also includes installing a unit module in or near each unit.

These and other objects, advantages and features of this invention will be apparent from the following description taken with reference to the accompanying drawing, wherein is shown the preferred embodiments of the invention.

BEST MODE FOR CARRYING OUT THE INVENTION

Figure 1:
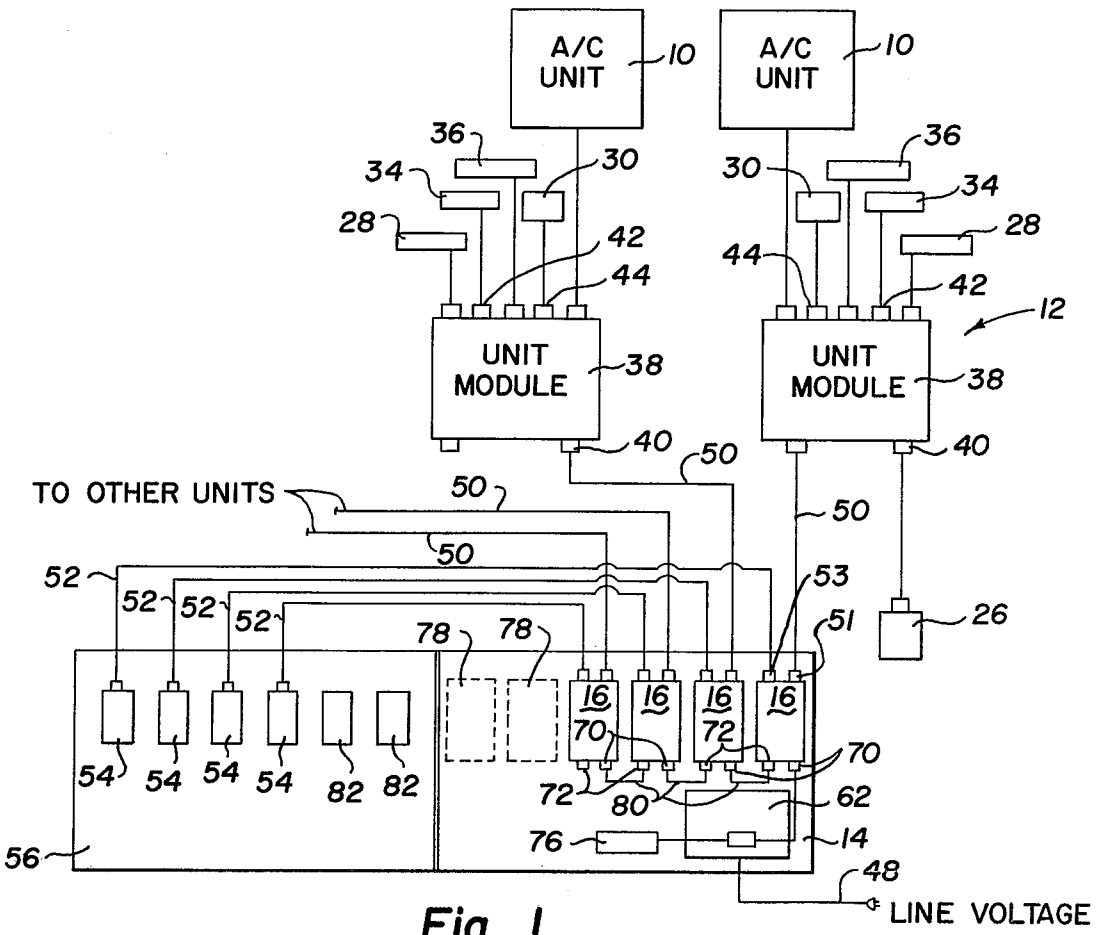
FIG. 1 is a diagramatic representation of a system according to the present invention.

Referring now to the drawing, and in particular to FIG. 1, a system according to the present invention for controlling a plurality of zoned environmental units 10 such as air heaters or air conditioners is referred to generally by reference numeral 12. System 12 includes a control panel 14 and a control module 16 associated with each unit 10. The control modules 16 are located on or within control panel 14.

Figure 2:
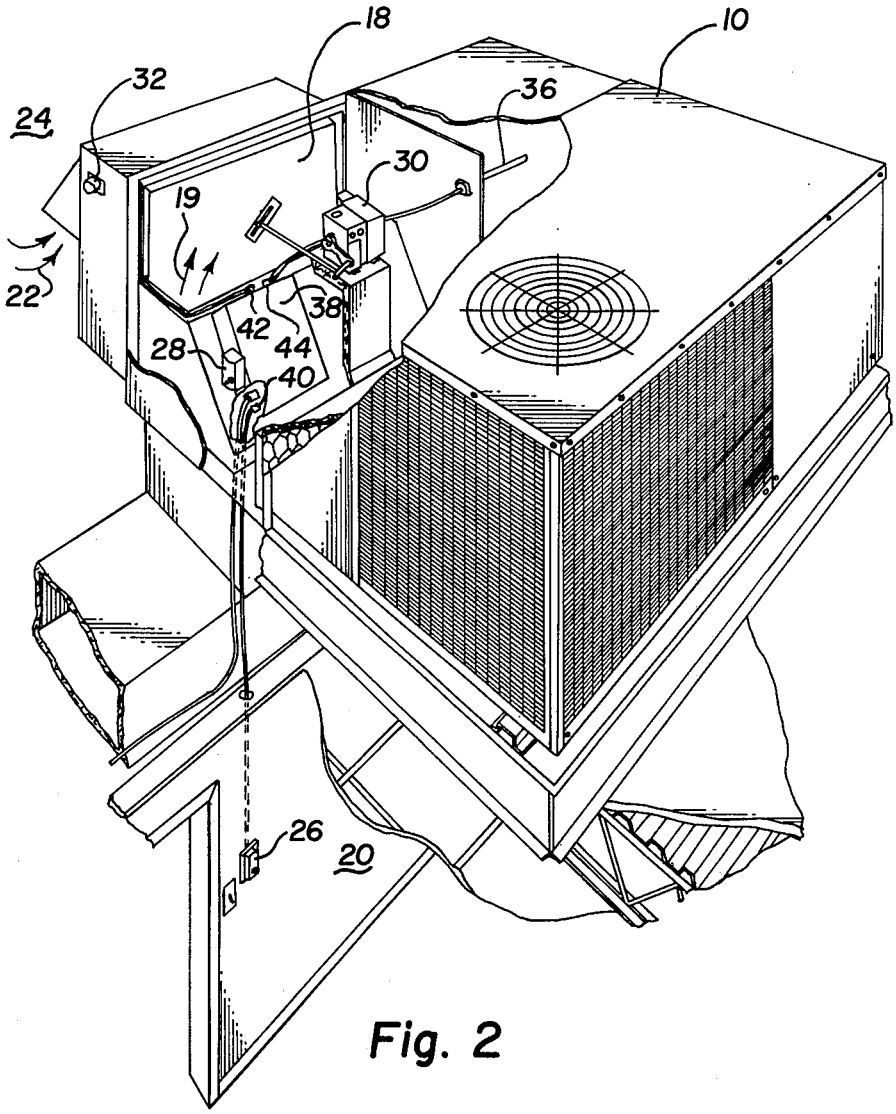
FIG. 2 is a pictorial representation partly cut away of an environmental zone and a zoned environmental unit in accordance with the present invention.

Referring also to FIG. 2, each zoned environmental unit 10 has means such as damper 18 for adjusting the ratio of intake air brought into the unit between return air 19 from environmental zone 20 and fresh air 22 from outside 24 the environmental zone. A blower motor which is not shown but which is conventional in the art forces the intake air through unit 10 and into environmental zone 20. Means is provided for sensing the temperature within each environmental zone 20 through a thermometer 26 placed within each environmental zone 20. Damper 18 is adjusted through means of motor 30. An outside air sensor 32 senses the temperature of the outside air 22, and an enthalpy control 34 comprising outside air sensor 32 in combination with motor 30 controls the intake air ratio adjusting means, damper 18, for maximum unit efficiency given a predetermined minimum percentage of fresh air. A discharge air sensor 36 detects the temperature of the air discharged from unit 10. A filter flag 28 is activated if the air filter needs to be replaced. In an alternative arrangement, the means for sensing the temperature in each environmental zone 20 is indirect by sensing the temperature of return air 19 by a return air sensor located at or near filter flag 28.

A unit module 38 is installed in or near each unit and is fully connectorized. Unit module 38 has connectors 40, 42 and 44 for thermometer 26, outside air sensor 32 and damper 18 through motor 30. In addition, unit module 38 contains a logic circuit which is not shown but of the type well known in the art for controlling unit 10 and the air ratio means made up of damper 18 controlled through motor 30.

Figure 3:
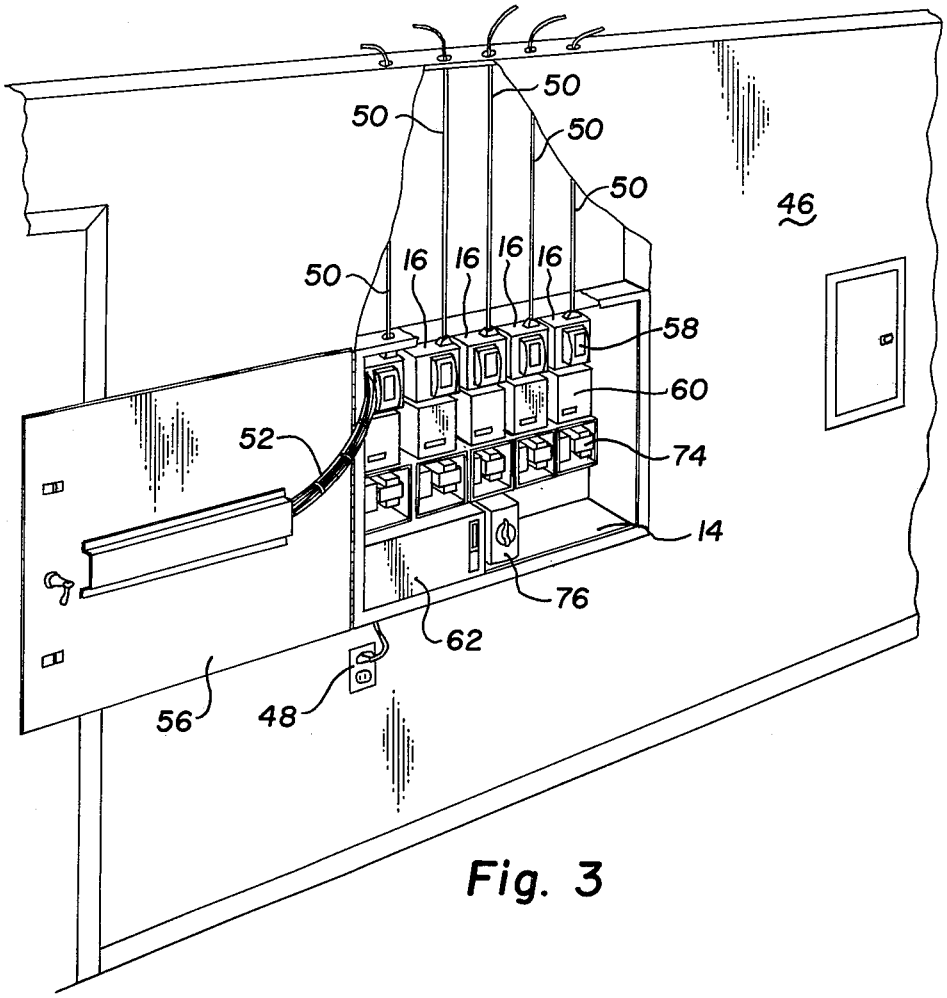
FIG. 3 is a pictorial representation of an installed panel and control modules in accordance with the present invention.
Figure 4:
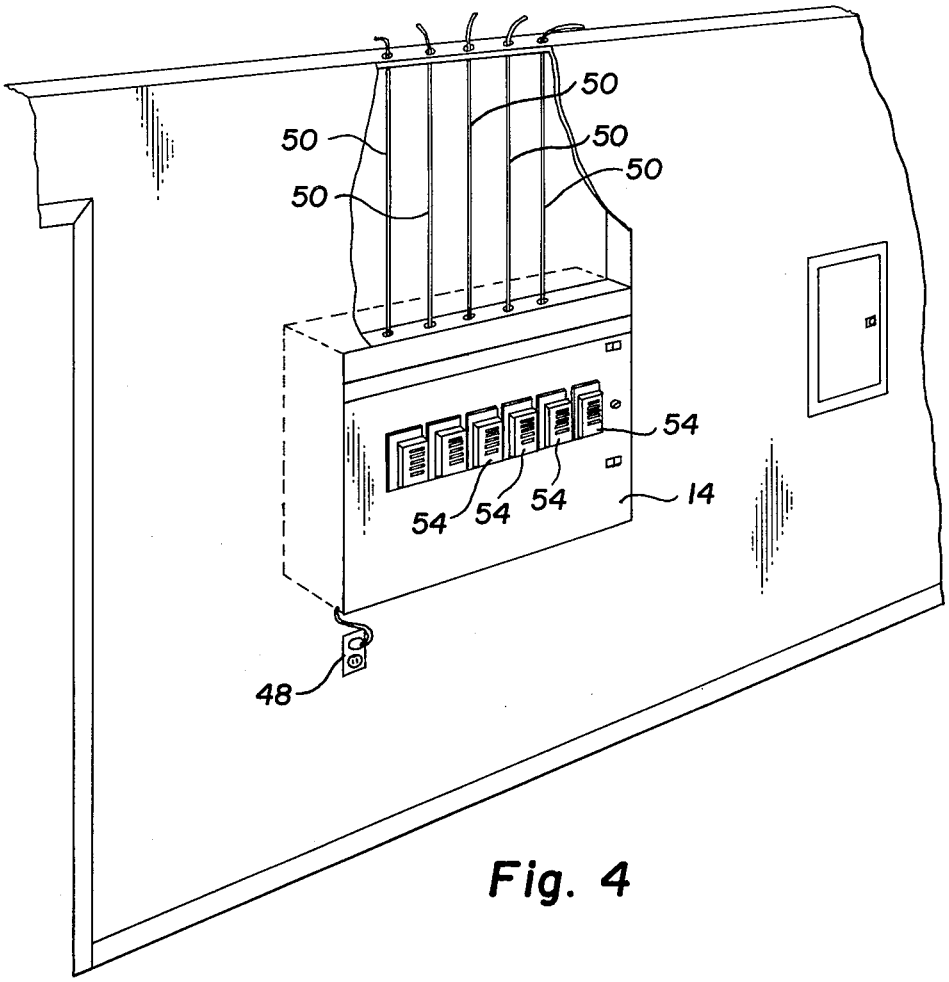
FIG. 4 is a pictorial representation of the installed panel and control modules of FIG. 3 with the panel door closed.

Referring now to FIGS. 3 and 4, panel 14 is located in an easily accessible space such as a hallway or maintenance room 46 with convenient access 48 to line voltage. Cables 50 connect modules 16 to their respective units 10 through unit modules 38, and cables 52 connect modules 16 to their respective status panels 54 on panel door 56. Status panels 54 include indicator lights which indicate the condition of various system parameters including whether a unit is in a heating mode or a cooling mode of operation.

Figure 5:
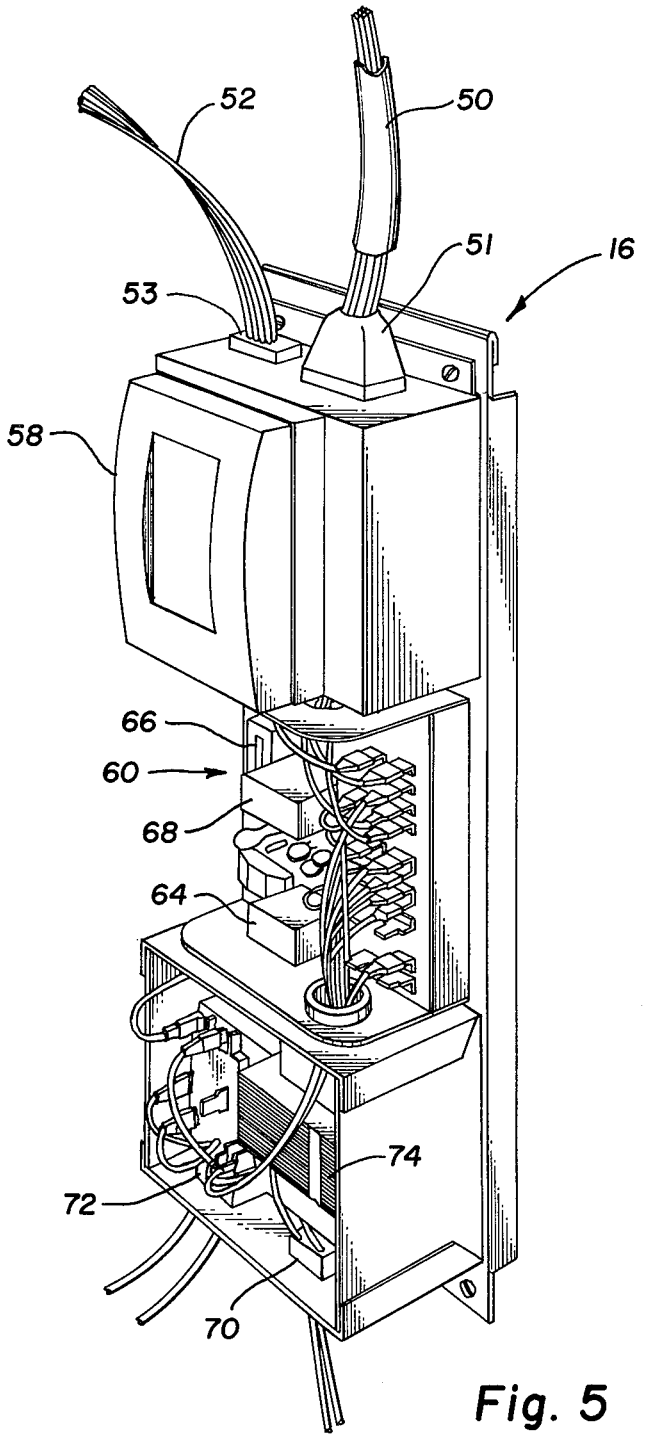
FIG. 5 is a perspective view of a control module in accordance with the present invention.

As seen more clearly in FIG. 5, a first temperature reference circuit 58 is located in each control module 16 for setting a first reference temperature. A second temperature reference circuit 60 in each module is for setting a second reference temperature. Means not shown but well known in the art is associated with each unit 10, most conveniently located in unit module 38, for turning unit 10 on when the difference between the temperature sensed by temperature sensing means comprising thermometer 26 or return air sensor 28 and the selected reference temperature for that unit is a predetermined turn on amount and off when the difference is a predetermined turn off amount. Referring also to FIG. 1, a clock 62, most conveniently located in panel 14, supplies the time whether time of day, week or other unit, to the system. Means 64 which can be located in module 16 are associated with each unit 10 and responsive to clock 62 for selecting the first reference temperature set by first temperature reference circuit 58 during a first predetermined time period and the second reference temperature set by second temperature reference circuit 60 during a second predetermined time period. First temperature reference circuit in a preferred embodiment comprises a temperature setpoint circuit for setting a setpoint temperature such as an operating temperature during normal working hours for the zoned environments. In such an embodiment, second temperature reference circuit 60 can comprise a temperature setback circuit 66 in each control module 16 for setting a setback temperature and a temperature reference circuit in each control module 16 responsive to clock 62 for setting a reference temperature equal to the setpoint temperature during the first predetermined time period of the clock and equal to the setpoint temperature plus the setback temperature during the second predetermined time period of the clock. The setback temperature will normally be positive during air conditioning cycles and negative during heating cycles.

Each control module 16 is fully connectorized. A unit module connector 51 and a status panel connector 53 are affixed to each control module 16. A clock-in connector 70 is affixed to each control module 16, and a clock-out connector 72 is likewise affixed to each control module 16. In a preferred embodiment, clock-in connector 70 and clock-out connector 72 also act as connectors for the line voltage which is brought in through clock 62. Clock-out connector 72 is electrically connected to clock-in connector 70 and clock-in connector 70 of each control module 16 is electrically connected to clock 62 or clock-out connector 72 of a different control module 16. The control modules are electrically connected in parallel combination to clock 62. Line voltage is brought into each module 16 to transformer 74 which steps the line voltage down to a safe operating voltage for module 16 and unit modules 38 along with their associated control apparatus.

System 12 further includes a manual override 76. Temperature reference circuit 68 in each control module 16 is responsive to manual override 76 rather than clock 62 when manual override 76 is activated.

It can thus be seen, that due to the modular construction of system 12, a method for installing such a system for controlling a plurality of zoned environmental units 10 includes the steps of installing panel 14, and installing on or in panel 14 a control module 16 for each unit 10, each control module containing means 58 and 60 for setting reference temperatures for the particular unit 10. A preferred method also includes installing a unit module 38 in or near each unit. With such a system, all that is necessary in order to install additional units is to install additional modules in available spaces 78 and plug in additional parallel connections 80 from the adjoining module 16, and make the connectorized connections to the unused indicator lights 82 through additional cables 52 and to unit modules 38 through additional cables 50. Indicator lights 54 or 82 could, of course, be made integral parts of module 16 rather than being separately connected. Indicator lights can also be combined with control buttons such as buttons for heat, cool, fan, etc.

The indicator lights can be used for emergency conditions as well as to indicate needed maintenance such as filter replacement, etc.

By use of the present invention the entire control system is mostly prewired and largely in modules for ease of installation.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A system for controlling a plurality of zoned environmental units such as air heaters or air conditioners, each unit having means for adjusting the ratio of intake air between return air from the environmental zone and fresh air from outside the environmental zone brought into the unit and a blower motor for forcing the intake air through the unit and into the environmental zone, the system comprising:

means for sensing the temperature within each environmental zone;

a control panel;

a control module associated with each unit, located on or within the control panel;

a temperature setpoint circuit located in each control module for setting a setpoint temperature;

a temperature setback circuit located in each control module for setting a setback temperature;

a clock;

a temperature reference circuit located in each control module, responsive to the clock for setting a reference temperature equal to the setpoint temperature during a first predetermined time period of the clock and equal to the setpoint temperature plus the setback temperature during a second predetermined time period of the clock;

means associated with each unit for turning the unit and the blower motor on when the difference between the temperature sensed by the temperature sensing means and the reference temperature for that unit is a predetermined turn on amount and off when the difference is a predetermined turn off amount; and connectors affixed to each control module and electrically connected to the temperature setpoint circuit, the temperature setback circuit and the temperature reference circuit located within that control module wherein those circuits can be installed as a single unit by installing the control module and electrical connections can be made to those circuits from the outside of that control module by use of the connectors.

2. A system according to claim 1 further comprising:

a clock-in connector affixed to each control module;

a clock-out connector affixed to each control module and electrically connected to the clock-in connector wherein the clock-in connector of each control module is electrically connected to the clock or the clock-out connector of a different control module, electrically connecting the parallel combination of the control modules to the clock.

3. A system according to claim 2 further comprising:

an enthalpy control associated with each unit, for controlling the intake air ratio adjusting means for maximum unit efficiency given a predetermined minimum percentage of fresh air.

4. A system according to claim 1 further comprising a manual override wherein the temperature reference circuit in each control module is responsive to the manual override rather than the clock when the manual override is activated.

5. A system according to claim 1 further comprising a manual override in each module wherein the temperature reference circuit in each module is responsive to the respective manual override rather than the clock when the manual override is activated.

6. A system for controlling a plurality of zoned environmental units such as air heaters or air conditioners, the system comprising:

means for sensing the temperature within each environmental zone;

a control panel;

a control module associated with each unit, located on or within the control panel;

a first temperature reference circuit located in each control module for setting a first reference temperature;

a second temperature reference circuit located in each module for setting a second reference temperature;

a clock;

means associated with each unit responsive to the clock for selecting the first reference temperature during a first predetermined time period and the second reference temperature during a second predetermined time period;

means associated with each unit for turning the unit on when the difference between the temperature sensed by the temperature sensing means and the selected reference temperature for that unit is a predetermined turn on amount and off when the difference is a predetermined turn off amount; and connectors affixed to each control module and electrically connected to the first and second temperature reference circuits within that control module wherein those circuits can be installed as a single unit by installing the control module and electrical connections can be made to those circuits from the outside of that control module by use of the connectors.

7. A system for controlling a plurality of zoned environmental units such as air heaters or air conditioners each unit having means for adjusting the ratio of intake air between return air from the environmental zone and fresh air from outside the environmental zone brought into the unit and a blower motor for forcing the intake air through the unit and into the environmental zone, the system comprising:

means for sensing the temperature within each environmental zone;

a control panel;

a control module associated with each unit, located on or within the control panel;

a temperature setpoint circuit located in each control module for setting a setpoint temperature;

a temperature setback circuit located in each control module for setting a setback temperature;

a clock;

a temperature reference circuit located in each control module, responsive to the clock for setting a reference temperature equal to the setpoint temperature during a first predetermined time period of the clock and equal to the setpoint temperature plus the setback temperature during a second predetermined time period of the clock;

means associated with each unit for turning the unit and the blower motor on when the difference between the temperature sensed by the temperature sensing means and the reference temperature for that unit is a predetermined turn on amount and off when the difference is a predetermined turn off amount;

a clock-in connector affixed to each control module; and a clock-out connector affixed to each control module and electrically connected to the clock-in connector wherein the clock-in connector of each control module is electrically connected to the clock or the clock-out connector of a different control module, electrically connecting the parallel combination of the control modules to the clock.

8. A system according to claim 7 further comprising:

an enthalpy control associated with each unit, for controlling the intake air ratio adjusting means for maximum unit efficiency given a predetermined minimum percentage of fresh air.

9. A system according to claim 7 further comprising a manual override wherein the temperature reference circuit in each control module is responsive to the manual override rather than the clock when the manual override is activated.

10. A system according to claim 7 further comprising a manual override in each module wherein the temperature reference circuit in each module is responsive to the respective manual override rather than the clock when the manual override is activated.

11. A system for controlling a plurality of zoned environmental units such as air heaters or air conditioners, the system comprising:

means for sensing the temperature within each environmental zone;

a control panel;

a control module associated with each unit, located on or within the control panel;

a first temperature reference circuit located in each control module for setting a first reference temperature;

a second temperature reference circuit located in each module for setting a second reference temperature;

a clock;

means associated with each unit responsive to the clock for selecting the first reference temperature during a first predetermined time period and the second reference temperature during a second predetermined time period;

means associated with each unit for turning the unit on when the difference between the temperature sensed by the temperature sensing means and the selected reference temperature for that unit is a predetermined turn on amount and off when the difference is a predetermined turn off amount;

a clock-in connector affixed to each control module; and a clock-out connector affixed to each control module and electrically connected to the clock-in connector wherein the clock-in connector of each control module is electrically connected to the clock or the clock-out connector of a different control module, electrically connecting the parallel combination of the control modules to the clock.

* * * * *